US008680033B2

(12) United States Patent
Creamer et al.

(10) Patent No.: US 8,680,033 B2
(45) Date of Patent: Mar. 25, 2014

(54) SCALE-REDUCING ADDITIVE FOR AUTOMATIC DISHWASHING SYSTEMS

(75) Inventors: Marianne Patricia Creamer, Warrington, PA (US); Joseph Manna, Quakertown, PA (US); Jan Edward Shulman, Newtown, PA (US)

(73) Assignee: Rohm and Haas Company, Philadelphia, PA (US)

( * ) Notice: Subject to any disclaimer, the term of this patent is extended or adjusted under 35 U.S.C. 154(b) by 68 days.

(21) Appl. No.: 12/720,330

(22) Filed: Mar. 9, 2010

(65) Prior Publication Data

US 2010/0234266 A1 Sep. 16, 2010

Related U.S. Application Data

(60) Provisional application No. 61/210,055, filed on Mar. 13, 2009, provisional application No. 61/337,274, filed on Feb. 2, 2010.

(51) Int. Cl.

| | |
|---|---|
| ***C11D 3/08*** | (2006.01) |
| ***C11D 3/10*** | (2006.01) |
| ***C11D 3/37*** | (2006.01) |
| ***C11D 7/12*** | (2006.01) |
| ***C11D 7/14*** | (2006.01) |
| ***C11D 17/00*** | (2006.01) |
| ***C11D 17/06*** | (2006.01) |
| ***C11D 3/395*** | (2006.01) |

(52) U.S. Cl.

CPC .. *C11D 3/08* (2013.01); *C11D 3/10* (2013.01); *C11D 3/3757* (2013.01); *C11D 3/3953* (2013.01); *C11D 7/12* (2013.01); *C11D 7/14* (2013.01); *C11D 17/0091* (2013.01); *C11D 17/06* (2013.01)

USPC ..... 510/223; 510/229; 510/230; 510/475; 510/478; 510/509; 510/511

(58) Field of Classification Search

CPC ..... C11D 3/08; C11D 3/10; C11D 3/3757; C11D 3/3953; C11D 7/12; C11D 7/14; C11D 17/06; C11D 17/0091

USPC ..... 510/229, 230, 223, 475, 478, 509, 511

See application file for complete search history.

(56) References Cited

U.S. PATENT DOCUMENTS

| | | | | |
|---|---|---|---|---|
| 4,203,858 | A | 5/1980 | Chakrabarti | |
| 4,608,188 | A | 8/1986 | Parker et al. | |
| 4,647,396 | A * | 3/1987 | Denzinger et al. | 510/476 |
| 4,659,793 | A | 4/1987 | Yang | |
| 5,023,001 | A * | 6/1991 | Amjad et al. | 210/699 |
| 5,055,540 | A * | 10/1991 | Hughes et al. | 510/471 |
| 5,273,675 | A | 12/1993 | Lein et al. | |
| 5,759,978 | A * | 6/1998 | Welch et al. | 510/230 |
| 5,858,944 | A | 1/1999 | Keenan et al. | |
| 6,114,294 | A | 9/2000 | Gauthier et al. | |
| 6,395,185 | B1 * | 5/2002 | Gauthier et al. | 210/701 |
| 6,867,173 | B2 | 3/2005 | Rodrigues | |
| 7,759,299 | B2 * | 7/2010 | Smith et al. | 510/224 |
| 7,781,387 | B2 * | 8/2010 | Feenstra et al. | 510/220 |
| 2005/0239681 | A1 * | 10/2005 | Speckmann et al. | 510/446 |

FOREIGN PATENT DOCUMENTS

| | | |
|---|---|---|
| EP | 0504091 | 9/1992 |
| EP | 0504091 A1 * | 9/1992 |
| EP | 0516553 | 12/1992 |
| EP | 1725642 | 11/2006 |

* cited by examiner

*Primary Examiner* — Lorna M Douyon
(74) *Attorney, Agent, or Firm* — Kenneth Crimaldi

(57) ABSTRACT

A phosphorus-free automatic dishwashing detergent composition containing a polymer of acrylic acid, maleic acid and methacrylic acid; a carbonate; and a silicate. The composition contains carbonate and silicate in a weight ratio from 4:1 to 1:3, respectively; from 10 to 90 wt % total carbonate and silicate.

9 Claims, No Drawings

SCALE-REDUCING ADDITIVE FOR AUTOMATIC DISHWASHING SYSTEMS

This application claims the benefit of priority under 35 U.S.C. §119(e) of U.S. Provisional Patent Application Nos. 61/210,055 filed on Mar. 13, 2009 and 61/337,274 filed on Feb. 2, 2010.

BACKGROUND

This invention relates generally to a formulation that minimizes mixed inorganic deposits in non-phosphate automatic dishwashing systems.

Automatic dishwashing detergents are generally recognized as a class of detergent compositions distinct from those used for fabric washing or water treatment. Automatic dishwashing detergents are required to produce a spotless and film-free appearance on washed items after a complete cleaning cycle. Phosphate-free compositions rely on non-phosphate builders, such as salts of citrate, carbonate, silicate, disilicate, bicarbonate, aminocarboxylates and others to sequester calcium and magnesium from hard water, and upon drying, leave an insoluble visible deposit. Polymers made from (meth)acrylic acid and maleic acid are known for use in inhibiting the scale or other insoluble deposits produced from non-phosphate builders. For example, U.S. Pat. No. 5,273,675 discloses polymers made from acrylic acid, maleic acid and methacrylic acid in a composition containing an alkali metal silicate. However, this reference does not disclose a composition or method for inhibiting formation of mixed inorganic deposits.

The problem addressed by this invention is to find a composition capable of reducing formation of mixed inorganic deposits.

STATEMENT OF INVENTION

The present invention is directed to a phosphorus-free automatic dishwashing detergent composition comprising: (a) a polymer comprising polymerized residues of: (i) 40 to 75 wt % acrylic acid, (ii) 5 to 25% maleic acid and (iii) 10 to 50 wt % methacrylic acid; and having M.sub.w at least 2,000 and a total amount of maleic acid and methacrylic acid residues comprises at least 26 wt % of the polymer; and (b) carbonate and silicate in a weight ratio from 4:1 to 1:3, respectively, wherein the composition comprises from 10 to 90 wt % total carbonate and silicate.

DETAILED DESCRIPTION

All percentages are weight percentages (wt %), and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic; the term "carbonate" to alkali metal or ammonium salts of carbonate, bicarbonate, percarbonate, sesquicarbonate; the term "silicate" to alkali metal or ammonium salts of silicate, disilicate, metasilicate; and the term "citrate" to alkali metal citrates. In some embodiments of the invention, the carbonates, silicates or citrates are sodium, potassium or lithium salts; alternatively sodium or potassium; alternatively sodium. The term "phosphorus-free" refers to compositions containing less than 0.5 wt % phosphorus (as elemental phosphorus), alternatively less than 0.2 wt %, alternatively less than 0.1 wt %, alternatively no detectable phosphorus.

The total weight of carbonate and silicate in the composition is from 10 to 90 wt % of the total weight of the composition. In some embodiments of the invention, total weight of carbonate and silicate is at least 15 wt %, alternatively at least 20 wt %, alternatively at least 25 wt %, alternatively at least 30 wt %, alternatively at least 35 wt %. In some embodiments, the total weight of carbonate and silicate is no more than 85 wt %, alternatively no more than 80 wt %, alternatively no more than 75 wt %, alternatively no more than 70 wt %, alternatively no more than 65 wt %, alternatively no more than 60 wt %. In some embodiments of the invention, the weight ratio of carbonate to silicate is no more than 3.5:1, alternatively no more than 3:1, alternatively no more than 2.5:1. In some embodiments, the weight ratio of carbonate to silicate is at least 1:2.5, alternatively at least 1:2, alternatively at least 1:1.5. In some embodiments of the invention, the composition further comprises an alkali metal citrate and/or aminocarboxylate. In some embodiments, the amount of alkali metal citrate is from 0.01 to 40 wt %, alternatively no more than 35 wt %, alternatively no more than 30 wt %, alternatively no more than 25 wt %, alternatively no more than 20 wt %.

In some embodiments of the invention, the polymer comprises polymerized residues which are at least 42.5 wt % acrylic acid, alternatively at least 45 wt %, alternatively at least 47.5 wt %, alternatively at least 50 wt %, alternatively at least 52.5 wt %., alternatively at least55 wt %, alternatively at least 57.5%, alternatively at least 60 wt %. In some embodiments, the amount of acrylic acid residues in the polymer is no more than 72.5 wt %, alternatively no more than 70 wt %, alternatively no more than 67.5 wt %, alternatively no more than 65 wt %, alternatively no more than 62.5 wt %, alternatively no more than 60 wt %, alternatively no more than 57.5 wt %, alternatively no more than 55 wt %, alternatively no more than 52.5 wt %, alternatively no more than 50 wt %. In some embodiments of the invention, the maleic acid residues are at least 7.5 wt % of the polymer, alternatively at least 10 wt %, alternatively at least 12.5 wt %, alternatively at least 15 wt %, alternatively at least 17.5 wt %. In some embodiments, the amount of maleic acid residues is no more than 22.5%, alternatively no more than 20 wt %, alternatively no more than 17.5 wt %, alternatively no more than 15 wt %, alternatively no more than 12.5 wt %. Typically, the polymer is made by polymerizing maleic anhydride, which is hydrolyzed to the acid during the polymerization process. All references to maleic acid residues in the polymer include metal salts of maleic acid residues which would be present at pH values near or above the pKa of the carboxylic acid groups. In some embodiments of the invention, the amount of methacrylic acid residues in the polymer is at least 12.5 wt %, alternatively at least 15 w %, alternatively at least 17.5 wt %, alternatively at least 20 wt %, alternatively at least 22.5 wt %, alternatively at least 25 wt %, alternatively at least 30 wt %, alternatively at least 35 wt %. In some embodiments, the amount of methacrylic acid residues in the polymer is no more than 47.5 wt %, alternatively no more than 45 wt %, alternatively no more than 42.5 wt %, alternatively no more than 40 wt %, alternatively no more than 35 wt %, alternatively no more than 30 wt %. In some embodiments of the invention, the total amount of maleic acid and methacrylic acid in the polymer is at least 26 wt %, alternatively at least 28 wt %, alternatively at least 30 wt %.

In some embodiments of the invention, the polymer contains no more than 5 wt % of esters of acrylic or methacrylic acid, alternatively no more than 2 wt %, alternatively no more than 1 wt %, alternatively no more than 0.5 wt %. In some embodiments of the invention, the polymer contains no more than 5 wt % of 2-acrylamido-2-methylpropanesulfonic acid (AMPS) (including metal or ammonium salts) or other sulfonated acrylic monomers, alternatively no more than 2 wt %, alternatively no more than 1 wt %, alternatively no more than 0.5 wt %, alternatively no more than 0.2 wt %.

In some embodiments of the invention, the polymer has $M_w$ of at least 4,000, alternatively at least 6,000, alternatively at least 8,000, alternatively at least 10,000, alternatively at least 12,000, alternatively at least 14,000. In some embodiments, $M_w$ is no more than 300,000, alternatively no more than 200,000, alternatively no more than 100,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, styrene monomers, AMPS and other sulfonated monomers, and substituted acrylamides or methacrylamides.

The polymer of this invention may be produced by any of the known techniques for polymerization of acrylic monomers. In some embodiments of the invention, the initiator does not contain phosphorus. In some embodiments of the invention, the polymer contains less than 1 wt % phosphorus, alternatively less than 0.5 wt %, alternatively less than 0.1 wt %, alternatively the polymer contains no phosphorus. In some embodiments of the invention, polymerization is initiated with persulfate and the end group on the polymer is a sulfate or sulfonate. The polymer may be in the form of a water-soluble solution polymer, slurry, dried powder, or granules or other solid forms.

Other components of the automatic dishwashing detergent composition may include, e.g., surfactants, oxygen and/or chlorine bleaches, bleach activators, enzymes, foam suppressants, colors, fragrances, antibacterial agents and fillers. Typical surfactant levels depend on the particular surfactant used, typically from 0.1 wt % to 10 wt %, alternatively from 0.5 wt % to 5 wt %. Fillers in tablets or powders are inert, water-soluble substances, typically sodium or potassium salts, e.g., sodium or potassium sulfate and/or chloride, and typically are present in amounts ranging from 0 wt % to 75 wt %. Fillers in gel formulations may include those mentioned above and also water. Fragrances, dyes, foam suppressants, enzymes and antibacterial agents usually total no more than 5 wt % of the composition.

In some embodiments of the invention, the composition contains at least 0.1 wt % of a hypochlorite salt, for example from 0.1 to 2 wt % alternatively from 0.5 to 1.5 wt %. In some embodiments of the invention, the composition has a pH (at 1 wt % in water) of at least 10, alternatively at least 11.5; in some embodiments the pH is no greater than 13.

The composition can be formulated in any typical form, e.g., as a tablet, powder, monodose, sachet, paste, liquid or gel. The composition can be used under typical operating conditions for any typical automatic dishwasher. Typical water temperatures during the washing process preferably are from 20° C. to 85° C., alternatively from 30° C. to 70° C. Typical concentrations for the composition as a percentage of total liquid in the dishwasher preferably are from 0.1 to 1 wt %, alternatively from 0.2 to 0.7 wt %. With selection of an appropriate product form and addition time, the composition may be present in the prewash, main wash, penultimate rinse, final rinse, or any combination of these cycles.

In some embodiments of the invention, the composition comprises from 0.5 to 12 wt % of said polymer, alternatively from 1 to 10 wt %, alternatively from 2 to 8 wt %, alternatively from 3 to 7 wt %, alternatively from 3.5 to 6.5 wt %. In some embodiments of the invention, the weight ratio of polymer to the total amount of carbonate and silicate is no more than 1:2, alternatively no more than 1:3, alternatively no more than 1:4, alternatively no more than 1:5, alternatively no more than 1:6, alternatively no more than 1:7. In some embodiments of the invention, the weight ratio of polymer to the total amount of carbonate and silicate is at least 1:25, alternatively at least 1:20, alternatively at least 1:15, alternatively at least 1:10.

EXAMPLES

Typical Polymer Preparation—To a two liter round bottom flask, equipped with a mechanical stirrer, heating mantle, thermocouple, condenser and inlets for the addition of monomer, initiator and chain regulator was charged 25.3 grams of maleic anhydride and 230 grams of deionized water. The mixture was set to stir and heated to 72° C. (+/−2° C.). In the meantime, a monomer solution of 210 grams of glacial acrylic acid and 60 grams of methacrylic acid was added to a graduated cylinder, thoroughly mixed for addition to the flask. An initiator solution of 8.3 grams of sodium persulfate was dissolved in 30 grams of deionized water and added to a syringe for addition to the kettle. A chain regulator (CTA) solution of 18 grams of sodium metabisulfite dissolved in 45 grams of deionized water was added to a syringe for addition to the kettle. A chain regulator pre-charge solution was prepared by dissolving 0.72 grams of sodium metabisulfite in 5 grams of deionized water and set aside. A promoter solution of 7.75 grams of a 0.15% iron sulfate heptahydrate solution was added to a vial and set aside.

Once the kettle contents reached reaction temperature of 72° C., the promoter solution was added, followed by the sodium metabisulfite pre-charge solution. After the reaction temperature recovered to 72° C., the monomer, initiator and CTA solution feeds were begun simultaneously. The monomer feed rate was constant over 90 minutes. The CTA cofeed was added linearly over 80 minutes and the initiator cofeed added linearly over 95 minutes at 72° C.

At the completion of the feeds, 5 grams of deionized water was added to the monomer feed vessel, as rinse. The reaction was held for 15 minutes at 72° C. In the meantime, the chaser solutions of 0.45 grams of sodium metabisulfite and 10 grams of deionized water was mixed and set aside, and 0.45 grams of sodium persulfate and 10 grams of deionized water was mixed and set aside.

At the completion of the hold, the above solutions were added linearly over 5 minutes and held for 15 minutes at 72° C. The chaser solution preps were repeated and added to the kettle over 5 minutes, followed by a 15 minute hold.

At the completion of the final hold, cooling was begun with the addition of 40 grams of deionized water. At 50° C. or below a solution of 146 grams of 50% sodium hydroxide was added to an addition funnel and slowly added to the kettle, controlling the exotherm to keep the temperature below 65° C. The funnel was then rinsed with 40 grams of deionized water. Finally, 4.5 grams of a scavenger solution of 35% hydrogen peroxide was added to the kettle. The reaction was then cooled and packaged.

The final polymer had a solids content of 41.1% (as measured in a forced draft oven at 150° C. for 60 minutes). pH of the solution was 5.05 and final M, as measured by Gel Permeation Chromatography was 18,060, and Mn was 3329. The residual monomer measured was <1 ppm acrylic acid, <1 ppm methacrylic acid, <1 ppm maleic acid, and 839 ppm fumaric acid.

Polymer Testing—All polymers were tested for scale reduction by incorporating them at 1 g, unless indicated otherwise, with sodium carbonate and/or sodium disilicate (BRITESIL H 20, PQ Corp.), and in some cases citrate, as indicated and washing glasses for 5 cycles in a Kenmore dishwasher (solids added to pre-wash and main wash cycles) using water with 400 ppm hardness (2:1 $Ca^{+2}$:$Mg^{+2}$) at 130° F. (54.4° C.) with no food soil. Glasses were evaluated after 1, 3 and 5 cycles using the scale from ASTM method 3556-85 (1=clean, 5=heavy film).

Tables 1-4 present results obtained using the polymer with a mixture of 4 g sodium carbonate and 6 g sodium disilicate.

TABLE 1

| polymer | $M_w$ | filming scores 1 cycle | 3 cycles | 5 cycles |
|---|---|---|---|---|
| none | — | 1.6 | 4.1 | 4.9 |
| 90 AA/10 Mal (phosphono end group, 1.7 wt % P) | 1.9K | 1.7 | 2.1 | 2.7 |
| 100 AA | 4.5K | 1.9 | 2.8 | 3.6 |
| 70 AA/30 MAA | 3.5K | 2.6 | 2.6 | 3.3 |
| 70 AA/20 Mal/10 MAA | 18.8K | 1.3 | 1.9 | 2.7 |
| 80 AA/10 Mal/10 MAA | 17.6K | 1.7 | 3.4 | 4.7 |
| 70 AA/10 Mal/20 MAA | 16.6K | 1.8 | 2.3 | 2.5 |
| 60 AA/10 Mal/30 MAA | 18.2K | 1.4 | 1.6 | 2.8 |
| 50 AA/10 Mal/40 MAA | 16.4K | 1.3 | 1.8 | 2.5 |
| 35 AA/10 Mal/55 MAA | 15.3K | 1.7 | 3.4 | 4.5 |

Note:
AA = acrylic acid;
Mal = maleic acid;
MAA = methacrylic acid;
numbers associated with these abbreviations indicate wt % in the polymer. In $M_w$, K = 1000, i.e., 1.9K = 1,900

The polymers used in the present composition are shown between the double lines. The first comparative entry (90 AA/10 Mal) contains phosphorus and thus is not desirable in a "phosphorus-free" formulation.

TABLE 2

| polymer | $M_w$ | filming scores 1 cycle | 3 cycles | 5 cycles |
|---|---|---|---|---|
| none | — | 1.8 | 4.5 | 5+ |
| 40 Mal/60MAA | 19K | 1.8 | 4.1 | 5 |
| 100 AA | 20K | 1.6 | 3.7 | 4.8 |
| 70 AA/30 MAA | 20K | 1.7 | 3.6 | 5+ |
| 70 AA/10 Mal/20 MAA | 16.6K | 2.0 | 3.4 | 4.4 |
| 60 AA/20 Mal/20 MAA | 34.2K | 1.4 | 3.1 | 4.1 |

In this set, the 70 AA/10 Mal/20 MAA polymer performed less well than in other runs, but is still better than the controls, as is the 60 AA/20 Mal/20 MAA polymer.

TABLE 3

| polymer | $M_w$ | filming scores 1 cycle | 3 cycles | 5 cycles |
|---|---|---|---|---|
| 70 AA/10 Mal/20 MAA | 16.6K | 1.2 | 1.7 | 3.1 |
| 75 AA/15 Mal/10 MAA | 15.7K | 1.3 | 2.0 | 3.9 |
| 75 AA/10 Mal/15 MAA | 14.8K | 1.5 | 2.6 | 4.3 |
| 80 AA/15 Mal/5 MAA | 15.2K | 1.2 | 2.1 | 3.5 |
| 80 AA/5 Mal/15 MAA | 18.5K | 1.7 | 3.6 | 5 |

TABLE 4

| polymer | $M_w$ | filming scores 1 cycle | 3 cycles | 5 cycles |
|---|---|---|---|---|
| 40 Mal/60MAA | 19K | 1.2 | 1.8 | 4.1 |
| 100 AA | 20K | 1.4 | 2.4 | 4.5 |
| 70 AA/30 MAA | 20K | 1.3 | 3.5 | 5.0 |
| 70 AA/10 Mal/20 MAA | 16.6K | 1.2 | 2.1 | 2.8 |
| 75 AA/15 Mal/10 MAA | 15.7K | 1.3 | 2.5 | 4.7 |
| 80AA/15Mal/5MAA | 15.2K | 1.3 | 1.8 | 2.2 |

Table 5 presents results obtained using the polymer with a mixture of 4 g sodium carbonate, 6 g sodium disilicate and 2 g sodium citrate.

TABLE 5

| polymer | $M_w$ | filming scores 1 cycle | 3 cycles | 5 cycles |
|---|---|---|---|---|
| none | — | 1.9 | 3.8 | 5.0 |
| 90 AA/10 Mal (phosphono end group) | 1.9K | 1.3 | 1.7 | 1.9 |
| 38 AA/62 Mal | 11K | 1.7 | 2.4 | 3.7 |
| 30 AA/70 Mal | 20K | 1.4 | 1.8 | 3.2 |
| 70 AA/10 Mal/20 MAA | 18.1K | 1.4 | 1.9 | 2.5 |
| 70 AA/10 Mal/20 MAA | 16.6K | 1.4 | 1.7 | 2.1 |

Table 6 presents results obtained using the polymer with 4 g sodium carbonate alone. This table is comparative because no silicate is present in these tests.

TABLE 6

(comparative)

| polymer | $M_w$ | filming scores 1 cycle | 3 cycles | 5 cycles |
|---|---|---|---|---|
| none | — | 2.7 | 5 | 5+ |
| 100 AA | 4.5K | 1.4 | 1.7 | 1.9 |
| 70 AA/10 Mal/20 MAA | 16.6K | 1.6 | 1.9 | 2.5 |

Table 7 presents results obtained using the polymer with 6 g sodium disilicate alone. This table is comparative because no carbonate is present in these tests.

TABLE 7

(comparative)

| polymer | $M_w$ | filming scores 1 cycle | 3 cycles | 5 cycles |
|---|---|---|---|---|
| none | — | 2.3 | 2.1 | 2.8 |
| 100 AA | 4.5K | 2.1 | 2.3 | 3.2 |
| 70 AA/10 Mal/20 MAA | 16.6K | 2.3 | 3.5 | 4.3 |

Table 8 presents results obtained using the polymer with a mixture of 2 g sodium carbonate and 8 g sodium disilicate. This table is comparative because the ratio of carbonate: silicate is 1:4, outside the range of the present invention.

TABLE 8

(comparative)

| polymer | $M_w$ | filming scores 1 cycle | 3 cycles | 5 cycles |
|---|---|---|---|---|
| none | — | 1.9 | 2.3 | 3.6 |
| 100 AA | 4.5K | 1.6 | 2.1 | 2.8 |
| 90 AA/10 Mal | 17.6K | 1.9 | 2.8 | 4.1 |
| 70 AA/10 Mal/20 MAA | 16.6K | 1.8 | 2.4 | 3.0 |

Table 9 presents results obtained using the polymer with a mixture of 8 g sodium carbonate and 2 g sodium disilicate.

TABLE 9

| polymer | $M_w$ | filming scores 1 cycle | 2 cycles | 3 cycles |
|---|---|---|---|---|
| none | — | 1.7 | — | 4.6 |
| 100 AA | 4.5K | 1.6 | 2.3 | 3.2 |
| 90 AA/10 Mal | 17.6K | 1.6 | 2.1 | 2.8 |
| 70 AA/10 Mal/20 MAA | 16.6K | 1.8 | 2.6 | 2.4 |

Table 10 presents results obtained using the polymer with a mixture of 6 g sodium carbonate and 2 g sodium disilicate.

TABLE 10

| polymer | $M_w$ | filming scores 1 cycle | 3 cycles | 5 cycles |
|---|---|---|---|---|
| none | — | 1.5 | 3.9 | 5+ |
| 70 AA/10 Mal/20 MAA | 16.6K | 1.3 | 2.2 | 2.9 |
| 75 AA/15 Mal/10 MAA | 15.7K | 1.5 | 1.9 | 3.2 |
| 75 AA/10 Mal/15 MAA | 14.8K | 1.4 | 2.8 | 3.6 |
| 80 AA/15 Mal/5 MAA | 15.2K | 1.5 | 3.1 | 4.7 |
| 80 AA/5 Mal/15 MAA | 18.5K | 1.6 | 3.6 | 4.3 |

Table 11 presents results obtained using the polymer with a mixture of 1.5 g sodium carbonate and 6 g sodium disilicate. This table is comparative because the ratio of carbonate: silicate is 1:4, outside the range of the present invention.

TABLE 11

(comparative)

| polymer | $M_w$ | filming scores 1 cycle | 3 cycles | 5 cycles |
|---|---|---|---|---|
| 70 AA/10 Mal/20 MAA | 16.6K | 1.2 | 2.7 | 3.3 |
| 75 AA/15 Mal/10 MAA | 15.7K | 1.2 | 2.4 | 3.1 |
| 75 AA/10 Mal/15 MAA | 14.8K | 1.2 | 3.4 | 4.2 |
| 80 AA/15 Mal/5 MAA | 15.2K | 1.2 | 2.5 | 4.5 |
| 80 AA/5 Mal/15 MAA | 18.5K | 1.3 | 2.2 | 3.5 |

Table 12 presents results obtained using the polymer with a mixture of 4 g sodium carbonate and 6 g sodium disilicate at varying polymer levels in grams, as indicated.

TABLE 12

| polymer | g | $M_w$ | filming scores 1 cycle | 3 cycles | 5 cycles |
|---|---|---|---|---|---|
| 100 AA | 5 | 20K | 2.5 | 3.3 | 3.9 |
| 70 AA/30 MAA | 5 | 20K | 1.7 | 2.3 | 2.8 |
| 70 AA/10 Mal/20 MAA | 5 | 16.6K | 1.9 | 2.1 | 2.4 |
| 70 AA/10 Mal/20 MAA | 2.5 | 16.6K | 1.4 | 1.8 | 2.7 |
| 70 AA/10 Mal/20 MAA | 1 | 16.6K | 1.4 | 1.6 | 3.8 |

The invention claimed is:

1. An automatic dishwashing detergent composition having less than 0.5 wt % phosphorus and comprising:

(a) a polymer comprising polymerized residues of: (i) 50 to 72.5 wt % acrylic acid, (ii) 7.5 to 15 wt % maleic acid and (iii) 10 to 42.5 wt % methacrylic acid; and having $M_w$ at least 2,000 and a total amount of maleic acid and methacrylic acid residues comprises at least 26 wt % of the polymer; and (b) carbonate and silicate in a weight ratio from 4:1 to 1:2, respectively, wherein the composition comprises from 10 to 90 wt % total carbonate and silicate.

2. The composition of claim 1 in which the composition comprises from 15 to 50 wt % total carbonate and silicate.

3. The composition of claim 1 in which the composition comprises carbonate and silicate in a weight ratio from 3.5:1 to 1:2.

4. The composition of claim 1 in which said polymer contains less than 0.5 wt % phosphorus.

5. The composition of claim 1 in which the composition comprises from 15 to 50 wt % total carbonate and silicate; and carbonate and silicate in a weight ratio from 3.5:1 to 1:2.

6. The composition of claim 5 in which said polymer has $M_w$ at least 8,000.

7. The composition of claim 6 in which said polymer comprises polymerized residues of:

(i) 60 to 70 wt % acrylic acid, (ii) 10 to 15 wt % maleic acid and (iii) 10 to 25 wt % methacrylic acid.

8. The composition of claim 7 in which said polymer contains less than 0.5 wt % phosphorus.

9. The composition of claim 8 further comprising at least 0.1 wt % of a hypochlorite salt.

* * * * *